US007777122B2

(12) United States Patent
Hurwitz et al.

(10) Patent No.: US 7,777,122 B2
(45) Date of Patent: Aug. 17, 2010

(54) MUSICAL NOTE SPEEDOMETER

(76) Inventors: Tobias Hurwitz, 238 E. Burke Ave., Towson, MD (US) 21286; Howard Davis, 207 Ocean Pkwy, Apt. 3G, Brooklyn, NY (US) 11218

( * ) Notice: Subject to any disclaimer, the term of this patent is extended or adjusted under 35 U.S.C. 154(b) by 43 days.

(21) Appl. No.: 12/214,066

(22) Filed: Jun. 16, 2008

(65) Prior Publication Data

US 2009/0308228 A1 Dec. 17, 2009

(51) Int. Cl.
*G10H 7/00* (2006.01)

(52) U.S. Cl. ..... 84/609; 84/616; 84/649; 84/654

(58) Field of Classification Search ..... 84/600–602, 84/609, 612, 616, 649, 652, 654
See application file for complete search history.

(56) References Cited

U.S. PATENT DOCUMENTS 4,084,473 A * 4/1978 Kitashima et al. ..... 84/731
4,692,117 A * 9/1987 Goodwin ..... 434/185
5,036,742 A 8/1991 Youakim
5,247,129 A * 9/1993 Nozaki et al. ..... 84/615
5,614,687 A 3/1997 Yamada
5,777,255 A * 7/1998 Smith et al. ..... 84/661
6,166,314 A * 12/2000 Weinstock et al. ..... 84/483.1
6,175,632 B1 1/2001 Marx
6,316,712 B1 11/2001 Laroche
6,323,412 B1 11/2001 Loo
6,343,151 B1 * 1/2002 King ..... 382/236
6,545,207 B2 4/2003 McAfee
6,787,689 B1 9/2004 Chen
6,812,394 B2 11/2004 Weissflog
7,031,243 B2 4/2006 Yamada
7,432,428 B2 * 10/2008 Kunisada et al. ..... 84/13
7,435,891 B2 * 10/2008 Perla ..... 84/470 R
7,572,969 B2 * 8/2009 Koseki et al. ..... 84/615
2002/0007717 A1 * 1/2002 Uehara ..... 84/600
2004/0250672 A1 * 12/2004 Moodie ..... 84/636
2005/0252362 A1 * 11/2005 McHale et al. ..... 84/616
2006/0021494 A1 * 2/2006 Teo et al. ..... 84/616
2007/0064954 A1 * 3/2007 Booth et al. ..... 381/58

(Continued)

OTHER PUBLICATIONS

U.S. Appl. No. 10/778,558, Feb. 13, 2004, Moodie.

(Continued)

*Primary Examiner*—David S. Warren
(74) *Attorney, Agent, or Firm*—Ober, Kaler, Grimes & Shriver; Royal W. Craig

(57) ABSTRACT

An electronic device that receives a signal indicative of the sound made my a musical instrument in order to determine the instantaneous rate of play of melodic notes on that instrument in terms of notes played per second and display the rate in real time via a display. The regularity of the musician's rate of play is further indicated by the stability of the display reading. Individual sustained melodic notes are identified utilizing differential capacitance and circuit delay time constants to generate a voltage differential in response to a step signal. The device is also selectively operable as a conventional metronome to provide an exemplary sound cue to the musician corresponding to a given number of notes per second and convertible by a switch or foot pedal to monitor the musicians rate of play as he tries to match the demonstrated rate.

28 Claims, 7 Drawing Sheets

U.S. PATENT DOCUMENTS

2007/0079693 A1* 4/2007 Valli et al. ..... 84/723
2008/0082506 A1* 4/2008 Saito et al. ..... 707/3
2008/0127798 A1* 6/2008 Sato et al. ..... 84/192
2008/0229907 A1* 9/2008 Clark ..... 84/454
2008/0250914 A1* 10/2008 Reinhart et al. ..... 84/645
2009/0152340 A1* 6/2009 George ..... 235/375

OTHER PUBLICATIONS http://electro-music.com/forum/post-182082.html, Apr. 19, 2008 and later.

* cited by examiner

FIG. 1
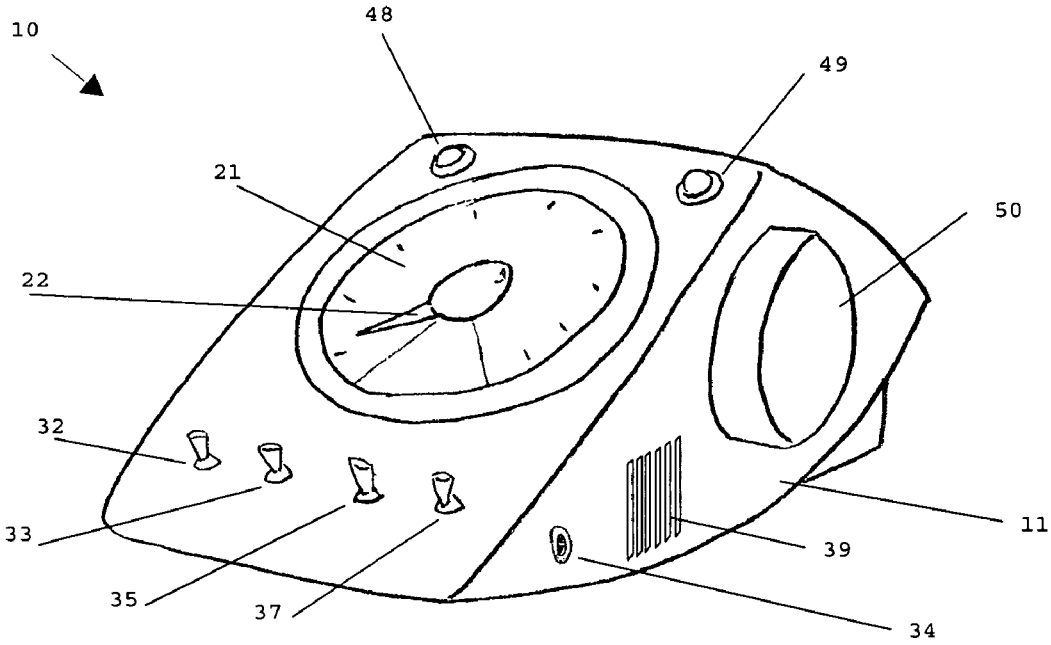
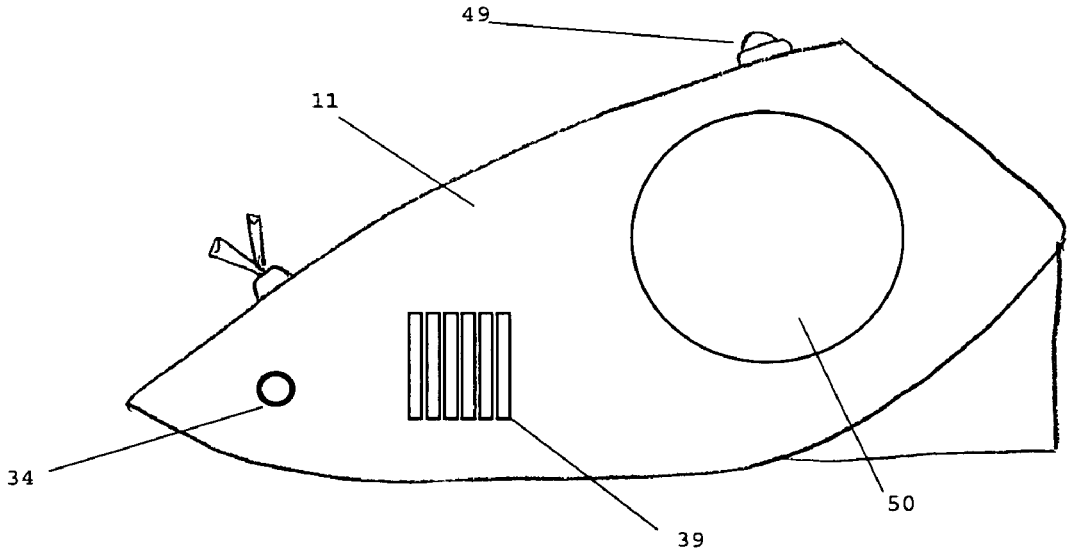
FIG. 3

FIG. 2
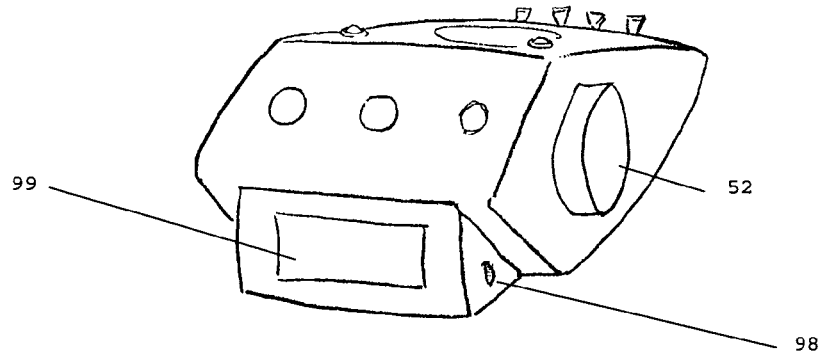
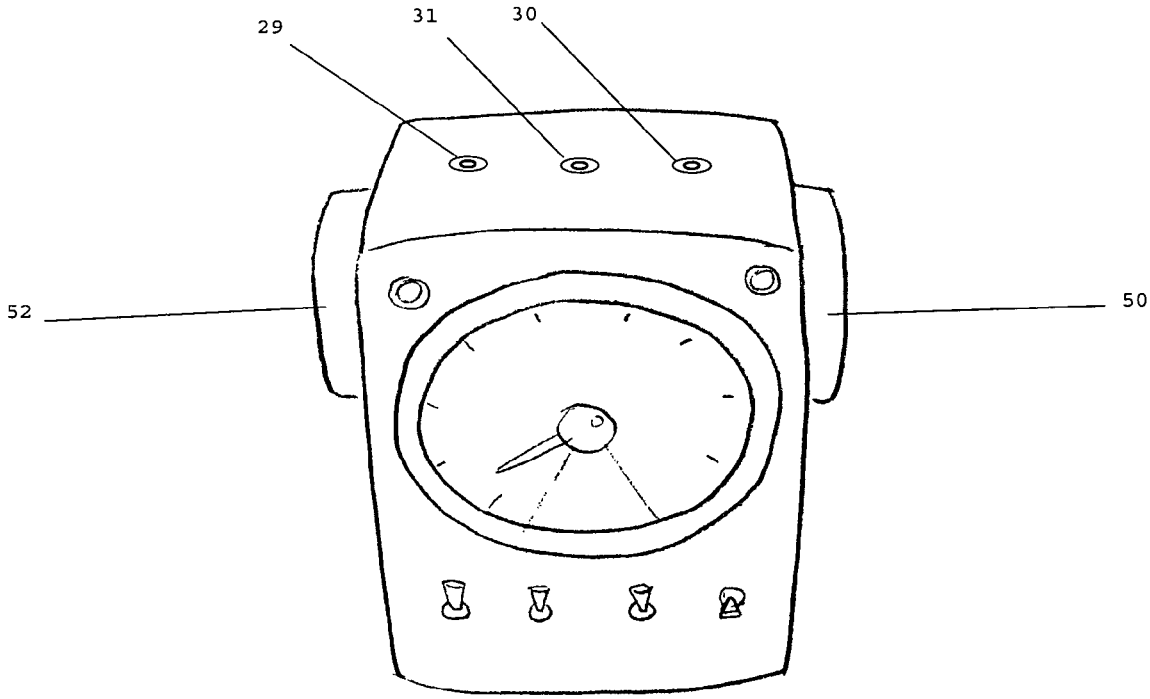
FIG. 4

MUSICAL NOTE SPEEDOMETER

BACKGROUND OF THE INVENTION

1. Field of the Invention

The present invention relates generally to the field of music accessories and more particularly to a device for determining the speed and regularity of play of musical notes and a method for making such determination.

2. Description of the Background

Musicians tend to be a competitive lot, often comparing their instrumental skills with other musicians. This is especially true in the genre of shred guitar, where the ability to play fast is a key skill in addition to properly forming and timing notes. Shred guitar generally refers to lead electric guitar playing that relies heavily on fast passages and the term is usually used with reference to rock and metal guitar playing although it is sometimes used with country, jazz fusion and blues. Shred guitarist use techniques such as tremolo picking, hammer-ons, pull-offs and sweep picking to play upwards of 12-18 notes per second in a given passage or run.

Practitioners and students endlessly debate who among them can play the fastest and young musicians continually try and emulate their idols in terms of speed and technical ability. This phenomenon is not unique to the shred guitar realm as musicians on piano, drums or most any other instrument try to gauge their skill and ability and continually practice and study to improve their craft. Of the skills to be acquired, timing, not just in terms of sheer speed of play but of regularity and accuracy of note play, is among the hardest to master when learning to play music of this or any type.

Most basically, music is the artful arrangement of sounds over time and thus timing, in addition to tonal qualities such as pitch and harmony, is a fundamental element. The term rhythm describes all aspects of music concerned with its structure related to time and the most basic rhythmic unit is the beat, which is a recurring time pattern or pulse that serves as the principal unit of musical time. Beats themselves are regulated by larger recurring units or divisions called measures which are the regular repetitive grouping of a pattern of strong and weak beats that form the meter of the music. Composers and musicians use tempo to define the absolute speed of a piece of music in terms of the number of musical beats played per minute of elapsed real time (Beats Per Minute or BPM).

It is over top of the temporal framework of meter and tempo that the notes of the guitar or other instruments form the melodies and harmonies of musical composition. Whereas beats are often indicated with the sharp strike of a drumstick on a drum head or closed hi-hat, melodic notes are often sustained for one or more measures and are layered over one another with the musician commonly playing several or many successive notes before the sustain of past notes has fully died out. This is particularly so with stringed instruments where a plucked string will continue to vibrate without continued energy input from the musician and where tremolo or other techniques are used to vary the pitch of a note repetitively without subsequent string interaction. In other situations, notes are played in a staccato fashion with numerous short, discrete notes played in succession with little or no sustain. In either case many notes may be played between the beats of the tempo and are layered over one another to built complex melodies and harmonies.

Considerable effort has historically gone into devices to aid musicians in measuring or monitoring the tempo of musical play in terms of beats per minute while substantially less effort has been directed at the timing of notes themselves with no useful devices consequently available to the musician for this purpose. The metronome is among the earliest and most widely used devices for monitoring tempo. Invented in 1812 in Amsterdam, the traditional metronome employs a mechanical clockwork to tick off regular intervals of time indicating the beats of music. Sophisticated metronomes can produce two or more distinct sounds to mark both the beats and indicate the start of each measure of music. Various electronic versions of the metronome have been developed in the modern age improving the accuracy with which they mark time but without appreciably expanding their functionality.

More specifically, while providing a benchmark of musical time, the metronome is incapable of recognizing or reporting the tempo of music played by a musician, to say nothing of recognizing individual melodic notes themselves. The ability to identify the instantaneous tempo of music is valuable to musicians, such as drummers, when practicing and preparing to play but only recently has technology advanced to develop devices to aid drummers in identifying the tempo of beats. The ability to identify the rate of melodic note play would also be valuable to musicians, particularly in shred guitar, although little apparent effort has been expended on this front and no such devices known until this time. One device intended to aid the drummer in learning to play a steady beat is the Combination Metronome And Tempo Monitor embodied in U.S. patent application Ser. No. 10/778,558 by Phillip Moodie. The device operates as a conventional metronome but is also capable of displaying the tempo in terms of beats per minute of a beat tapped out with a drumstick on the casing of the device itself. The device is apparently intended for use by a drummer in conjunction with a drum kit. The tempo monitoring device of U.S. Pat. No. 5,036,742 to Phillip Youakim is of same vein and works to identify the beats per minute of a tempo beat out on a drum to which it is directly affixed. These devices, by various means, are capable of identifying the regular high attack, high decay wave form of a percussive drumbeat having little or no sustain. They are, however, limited to use with a single drum on which only the beat is continually tapped out, cannot identify the beat within a complex rhythm and are of no use whatsoever with respect to determining the rate and regularity of sustained melodic notes.

The Electric Drum Stroke Counting Machine of U.S. Pat. No. 6,545,207 to Derrell McAffee, et al. is similarly limited to use with a single drum on which high attack/high decay percussive drumbeats are played but operates without regard to musical beat. Rather, the device provides a counting device recording the total number of drum strikes made in a given time period. From this a user could independently determine an average rate of play at the conclusion of that time period. This provides drummers with a quantitative average play rate over a period (for example 60 seconds) which they can compare with the rate and skill of other drummers. However, the average play rate over a given time may be considerably less than the instantaneous maximum play rate achieved by the musician and is an imprecise measure of overall speed. Further, by providing feedback only as an average rate at the conclusion of a drum session, as opposed to an instantaneous rate during play, the disclosure of McAffee does not provide the musician or student with useful information during practice with respect to speed and temporal regularity.

To the musician playing electric guitar or the piano these devices are of no use. Such musicians cannot tap out a tempo with their instruments nor are they marking the beat of the music but rather are playing melody or other accompaniment in the form of sustained notes of irregular time and duration. As such they are not concerned with how accurately and regular the beat is played but rather how fast (or slow) and regularly the individual notes of a riff are played. In order to improve the accuracy and timing of his play and/or to provide a quantitative measure of speed, a musician or musical student on these instruments needs a device capable of providing feedback as to the instantaneous rate of play in terms of the number of notes played per second and the regularity with which those notes are played in real time as the piece is played.

It is, therefore, an object of the present invention to provide a device capable of identifying the speed of execution of irregular sustained melodic notes on a musical instrument It is further an object of the present invention to provide a device capable of displaying the instantaneously speed of play of such notes to the musician in real time so that the musician can improve his performance during repetitive practice and can quantitatively compare his speed of play with other musicians.

It is further an object of the present invention to provide a device capable of providing instantaneous feedback in real time regarding regularity of note timing to a musician.

SUMMARY OF THE INVENTION

According to the present invention, the above described and other objects are accomplished by an electronic device that receives an analog signal from the pickups of electric instruments such as an electric guitar or electric piano, filters that signal and utilizes a differential amplifier to identify increases in signal amplitude indicative of the string picks and plucks of note play. A signal generator then signals a meter driver to display the proper value for the number of notes played per second. In one embodiment of the invention the device is operable as a conventional metronome to provide an exemplary sound cue to the musician corresponding to a given number of notes per second and is convertible by a switch or foot pedal to monitor the musicians rate of play as he tries to match the demonstrated rate.

The regularity of the musician's rate of play is indicated by the stability of the display reading. An erratic display indicates inaccurate note timing and provides positive feedback so that the musician may correct the play and thus the display. A dip in the displayed play rate indicates that the musician is not keeping up with the intended time whereas a rise in the display dial indicates the musician has gotten ahead of the musical time. Variable sensitivity is provided for both note timing accuracy (display sensitivity) and note speed of play such that users of varying skill levels may use the device, the direction of the needle deflection being indicative of whether the musician is too slow or two fast. As the musician becomes more skilled in his instrument the sensitivity may be recalibrated in keeping with his ability.

BRIEF DESCRIPTION OF THE DRAWINGS

Other objects, features, and advantages of the present invention will become apparent from the following detailed description of the preferred embodiments and certain modifications thereof when taken together with the accompanying drawings in which like numbers represent like items throughout and in which:

FIG. 1 is a three quarters front perspective view of the musical note speedometer FIG. 2 is a is a three quarters rear perspective view of the musical note speedometer FIG. 3 is a right side view of the musical note speedometer FIG. 4 is a top view of the musical note speedometer

DETAILED DESCRIPTION OF THE PREFERRED EMBODIMENT

Figure 5:
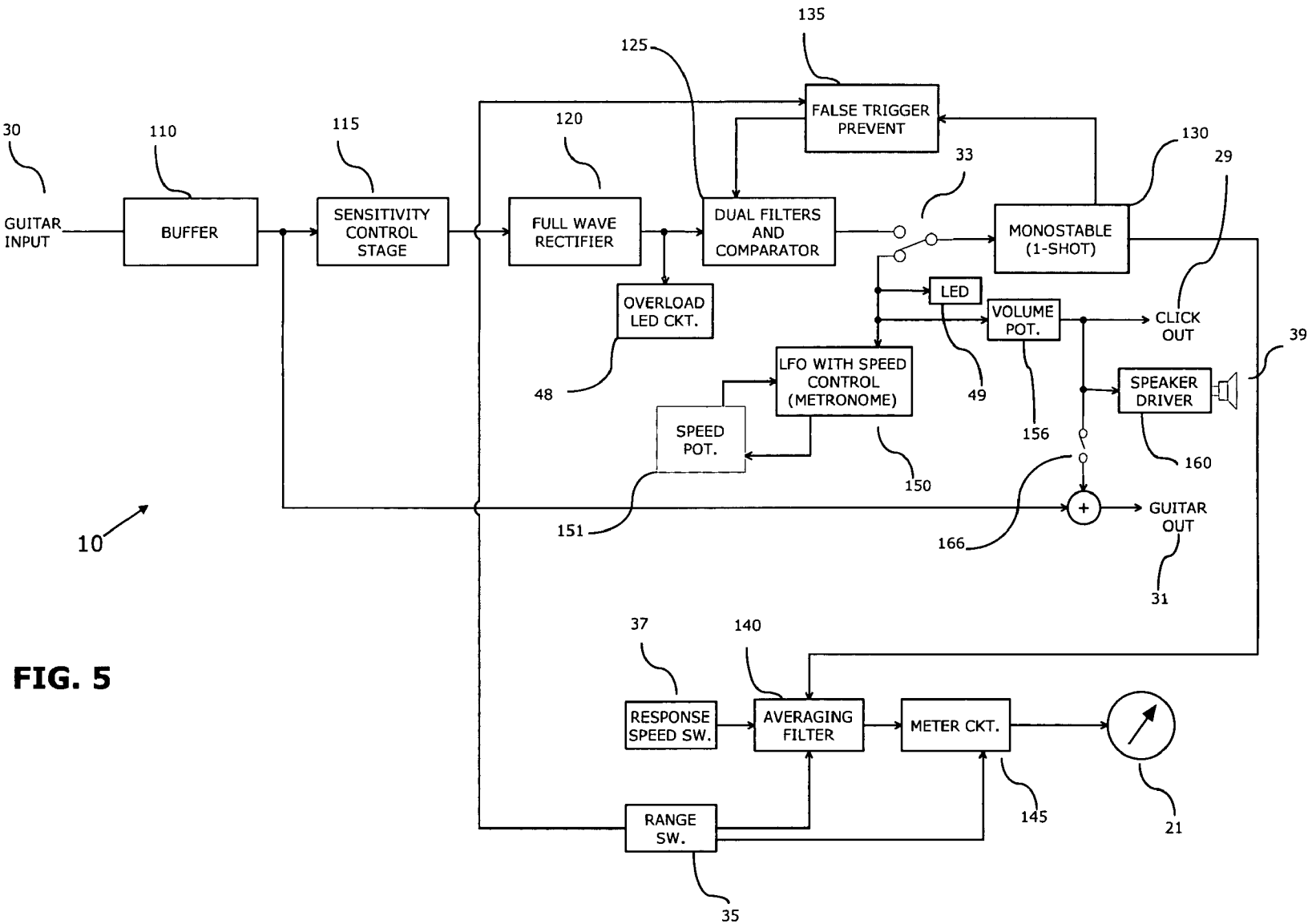
FIG. 5 is a block diagram of the musical note speedometer circuitry.

For the purposes of promoting an understanding of the principles of the invention, reference will now be made to the embodiment illustrated in the drawings, which is described below. The embodiment disclosed below is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

The invention is a musical note speedometer device for actively determining the rate of play of musical notes by a musical instrument, and particularly an electric guitar. The musical note speedometer preferably employs two different modes to allow a user to switch at will between a "metronome mode" and a "speedometer mode." Although somewhat similar to a conventional metronome, the device, when set to metronome mode, provides an exemplary series of audible clicks corresponding to the number of notes per second the musician is attempting to play as differentiated from the musical beat in terms of beats per minute. In speedometer mode the device determines and displays the number of notes per second actually being played by the musician on a connected instrument. Speedometer mode allows the musician to receive instantaneous feedback as to his performance in terms of sheer notes per second played as well as regularity of notes (if desired) in real time while playing and to adjust his play accordingly to improve. An embodiment of the invention is adapted to quantitatively determine the maximum rate of play in terms of the number of notes player per second so as to allow musician and music students to compare their abilities with those of their peers.

FIG. 1 shows a three-quarters front perspective view of a musical speedometer 10 according to the present invention. FIG. 2 shows a three-quarters rear perspective view of a musical speedometer 10 according to the present invention. FIG.'S 3 and 4 show a right side view and top front perspective view of the invention, respectively. With combined reference to FIG.'S 1 through 4, the musical speedometer 10 includes a housing 11 equipped with a female input jack 30 in the rear into which the output cable (not claimed) of an instrument such as an electric guitar may be inserted. Typically a ¼ inch cable with male jack ends is utilized to connect electric musical instruments to amplifiers and the like and the present invention is intended for use with such standard cables/jacks although other means of receiving a signal from an instrument may be utilized, including acoustic (non-electric) instruments. A quarter inch female output jack 31 is provided for connection via similar cabling as described above to an audio amplifier or the like, serving as an auxiliary output of the electric instrument and/or musical speedometer 10 signals. An additional female output jack 29 may be provided at the rear of the device to allow headphones or the like to be connected. Overload LED 48 provides an indication that the line in signal received from the guitar is too high and must be reduced for proper operation.

A master power switch 32 is provided on the face of the device as depicted in FIG. 1 for turning the device on or off. A mode selector switch 33 is further provided on the face of the device for selecting between metronome mode and speedometer mode as previously described. A ¼ inch or similar female input jack 34 is provided for connection of an external foot pedal switch, to alternately permit hands free switching between metronome mode and speedometer mode while continuing to play the instrument being monitored.

When operating in metronome mode, rotary dial 52 allows the user to control the number of audible clicks per second demonstrated by the device. Rotating the dial 52 so as to increase the exemplary rate of notes per second causes the device to generate a signal (as described below) representative of that rate of play and provide that signal simultaneously to the rate determining component of the device and the speaker 39. The rate determining circuitry causes the display dial 22 of display 21 on the front face of the device to display the number of exemplary clicks played per second. Simultaneously a speaker driver (described below) is connected to speaker 39, seen in FIG. 3, to output the clicks so that the user can perceive what that rate of play sounds like and attempt to emulate it. Additionally a visual cue as to exemplary rate of play is provided by LED 49 which is caused to blink synchronously with the audible clicks. As the exemplary signal generated by the device is entirely regular, dial 22 of display 21 will remain perfectly steady when displaying the rate in metronome mode. The volume of the exemplary clicking, output either by speaker 39 or headphone jack 29, is controlled by dial 50 on the right side of the device. It is also possible to provide the audio click signal to output jack 31 to be heard through an amplifier connected thereto.

Upon switching to speedometer mode, dial 22 of display 21 will no longer display the rate of the exemplary metronome but rather will begin to display the rate of note play by the musician as determined by the note identification circuit (described below). The exemplary audible and visual cues provided via speaker 39 and LED 49 remain available to the musician or may be switched off entirely. Dial 22 of display 21, in speedometer mode, will fluctuate in accordance with fluctuations of the rate of speed of play by the musician providing an indication of both the actual instantaneous speed of note play, and the ability of the musician to maintain that speed at a steady rate. The musician may, of course, attempt to simply play as fast as possible and observe the dial 22 climb as he increases his rate and skill without regard to regularity of rate. Alternatively, the musician may attempt to play at a constant rate and hold the dial 22 at a certain target level to improve timing accuracy. Display 22 is preferably provided with multiple display scales to accommodate musicians and students having a wide range of skills. Here, switch 35 allows the user to switch between two scales, the first scale encompassing a range from 0 to 11 notes per second and the second scale encompassing a range of 0 to 22 notes per second.

As with the display scale itself, the sensitivity of display 21 to fluctuations in the rate of play may be adjusted to accommodate the skills and abilities of a wide range of musicians and students. Switch 37 allows the user to select either an "easy" or "hard" setting with respect to dial 22 sensitivity. In "easy" mode the dial is less sensitive to variations in note timing and the swings of the dial 22 are dampened as compared to the sensitivity of the "hard" mode. Users may freely switch between "easy" and "hard" modes during play.

As depicted in FIG. 2, a power input jack 98 is provided in the rear of the device for connection to an external power supply. Power supply may be via a step down transformer to reduce line voltage to the level necessary to operate the device, typically 9 volts. A nine volt battery source may also be provided in an internal battery compartment 99.

Figure 6A:
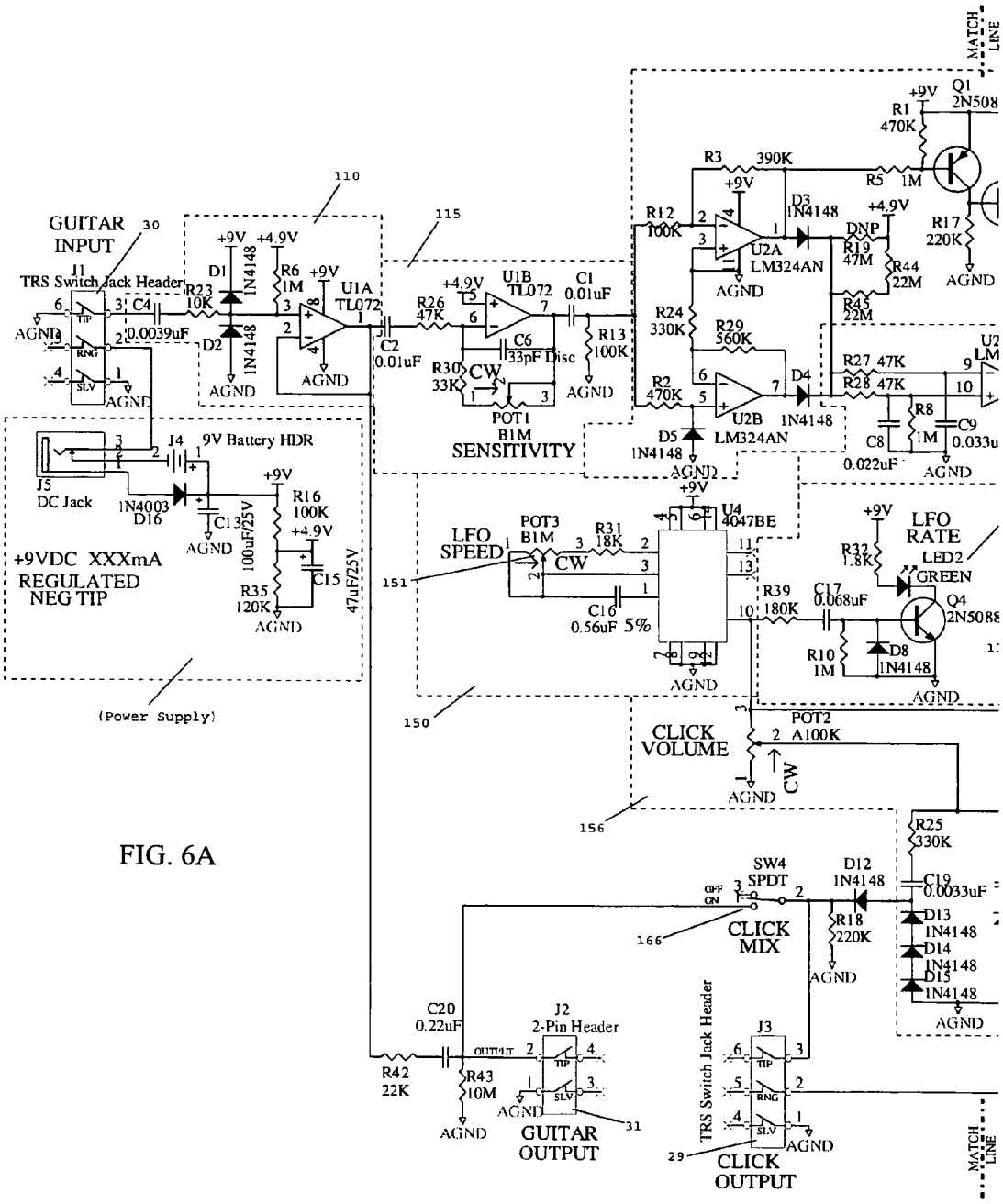
FIG. 6 is a schematic diagram of the musical note speedometer circuitry.
Figure 6B:
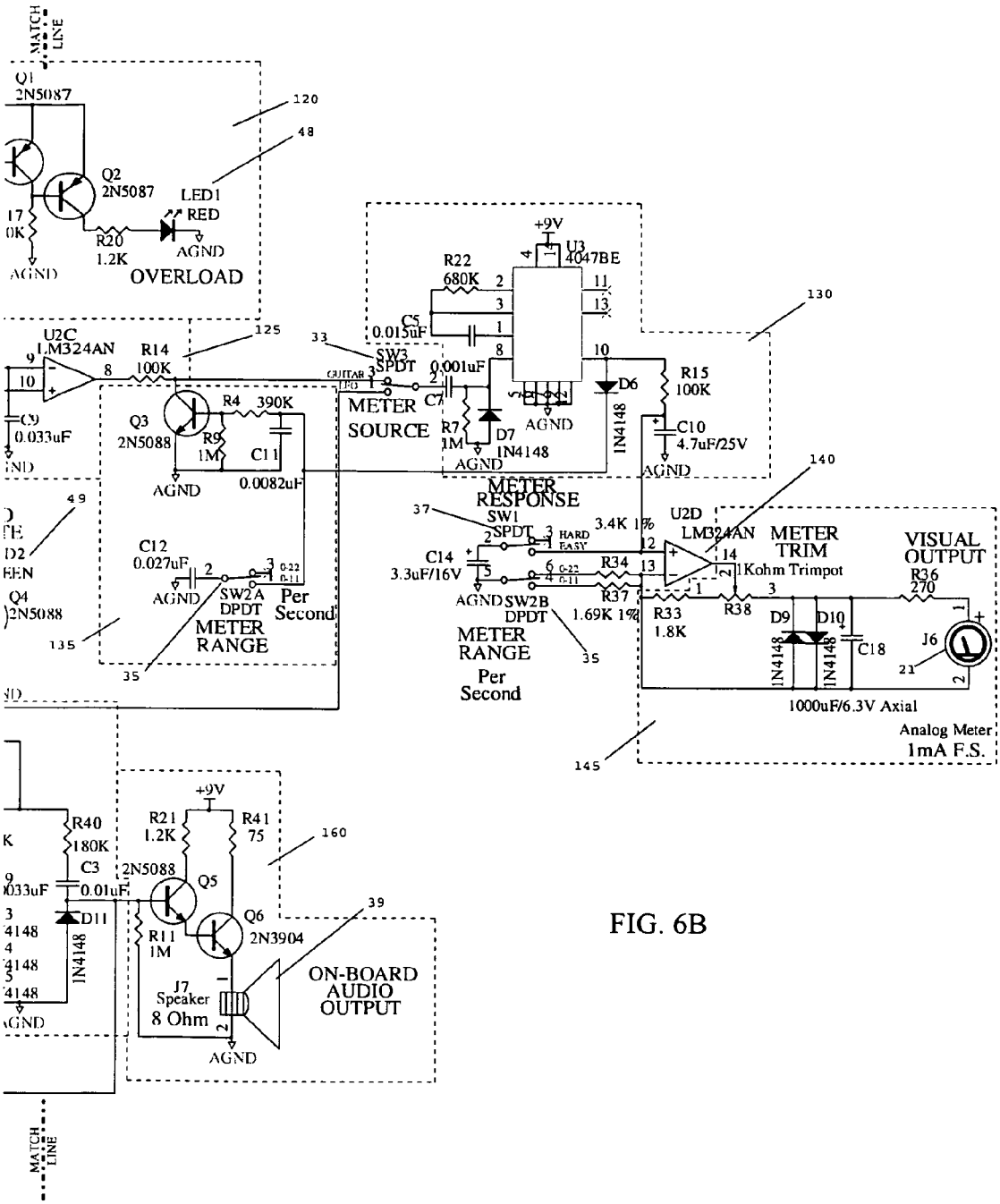

FIG. 5 shows a block diagram of one embodiment of the present musical note speedometer 10, and FIG. 6 is an exemplary analog circuit implementation schematic of the musical note speedometer. With combined reference to FIGS. 5 and 6, switch 33 is set to display the speed of the exemplary signal provided in metronome mode. In metronome mode, the output of a low frequency oscillator ("LFO") 150 is connected to the input of pulse generator 130. Double pole switch 33 is utilized to switch the input of pulse generator 130 between the exemplary metronome note signal provided at the output of the LFO 150 and the note detection signal provided at the output of the comparator 125 (as described below). As seen in FIG. 6, a 4047BE stable multivibrator integrated circuit may be utilized as the low frequency oscillator 150 in conjunction with potentiometer 151 (controlled by dial 52 of FIG. 2) to vary the exemplary signal rate provided to the pulse generator. Potentiometer 151 is typically a 1 M ohm linear potentiometer.

Pulse generator 130 may also be a 4047BE multivibrator integrated circuit configured for monostable operation and provides a single discrete voltage pulse to the input of an averaging filter 140 in direct response to the exemplary signal generated by the LFO 150 (or from the comparator in speedometer mode). Averaging filter 140 may be an operational amplifier and is typified by the LM324 low power quad operational amplifier which consists of four independent, high gain, internally frequency compensated operational amplifiers in a single integrated circuit.

Double pole range switch 35, previously described, is used to adjust the output of averaging filter 140 and display range of display 21 via meter circuit 145 to correspond with the vibrating strings of the instruments playing a note as detected by the pickups of the instrument. The amplitude of the analog input signal corresponds with the intensity of the string vibration. A potentiometer controlled variable gain sensitivity control stage 115 permits adjustment of the signal to within the operating parameters of the device. The potentiometer of sensitivity control stage 115 may be a 1 M Ohm potentiometer. Overload LED 48 is provided to indicate signal overload and provide feedback for adjustment of the control stage 115. Adjustment of the input signal to within optimum operating levels is necessary due to variations in instrument pickups, instrument output settings and musician technique. As seen in FIG. 6, sensitivity control stage 115 may utilize one op-amp of an LM324 low power quad operational amplifier configured as a low cut filter to remove signal noise below approximately 80 Hz thereby eliminating line noise and electromagnetic interference.

The output of sensitivity control stage 115 is provided to the input of a full wave rectifier 120. Full wave rectifier is comprised of a pair of operational amplifiers of the LM324 low power quad operational amplifier, and outputs a fully rectified DC signal representative of the instrument output to the input of the dual filter and comparator 125. The rectified signal maintains the original waveform amplitude corresponding to note intensity. Dual filter and comparator 125 utilizes dual resistor/capacitor pairs across an op amp of the LM324 to detect increases in the amplitude of the signal from the rectifier 120 indicative of a note being played. Identical resistors are used in combination with capacitors of differing capacitance to create a voltage differential between the inverting and non-inverting leads of the op amp in response to each note played. For example, a 0.033 μf capacitor ($C_2$) with a 47 K ohm resistor is connected between the rectifier output and the inverting lead of the op amp, in one embodiment the rate of play of the instrument by altering the resistance of the circuit. For example, in the illustrated embodiment of the present invention a switch 35 alternates between a 1.69K resistor when a note speed of 0-11 notes per second is expected while a 3.4K resistor is utilized when speeds of 0-22 notes per second are expected. Similarly response speed switch 37, also previously described, is used to alter the sensitivity of the averaging filter 140 to irregularities in timing of signals received from the pulse generator Speed switch 37 corresponds to switch 37 in FIG. 1

The output of low frequency oscillator ("LFO") 150 is also connected to the input of speaker driver 160 via volume potentiometer 156 (operated by dial 50 of FIG. 1) for audibalization of the regular exemplary click or tone via speaker 39, whether in metronome mode or in speedometer mode. The exemplary click signal of the LFO 150 is also simultaneously provided via potentiometer 156 to a click line out 29 for connection to a headset or the like and selectively via switch 166 to the signal output jack 31 for combination with the guitar (or other instrument) signal to be provided to an external power amplifier. LED 49 is likewise simultaneously illuminated in coordination with the LFO 150 signal to provide visual indication of the exemplary notes.

When operating in speedometer mode, switch 33 disconnects the output of the LFO 150 from the pulse generator 130 and connects the output of the note detector circuitry to drive the display. The note detector circuitry is comprised of gain buffer 110 which receives the guitar input signal from guitar input 30. The guitar input signal, in the exemplary embodiment, is received in the form of an analog signal from the electric guitar or other electric instrument, although receipt of a signal corresponding to the sound made by an acoustic instrument is contemplated. The frequency of the analog input signal corresponds directly to the frequency of of the present invention (see FIG. 6), while a 0.022 μf capacitor ($C_1$) with a 47 K ohm resistor is connected between the rectifier output and the non-inverting lead of the op amp.

Use of the dual resistor/capacitor pairs takes advantage of the time-delay between signal input and output experienced by all electrical circuits when a step voltage or signal is first applied or altered. This delay is sometimes referred to as the time constant and represents the response time of the circuit to changes in the applied signal. The time constant (T) is a function of the connected reactive components, either capacitive or inductive, and for a resistor/capacitor series pair such as that of the present invention is measured by the equation T=R×C, in seconds, where R is the value of the resistor in Ohms and C is the value of the capacitor in Farads. All other things being equal, $T_{C1}$=(47,000 ohms×(2.2×$10^{-8}$ farads))=0.001034 seconds and $T_{C2}$=(47,000 ohms×(3.3×$10^{-8}$ farads))=0.001551 seconds. Thus $T_{C2}$ is 50% longer than for $T_{C1}$.

Figure 7:
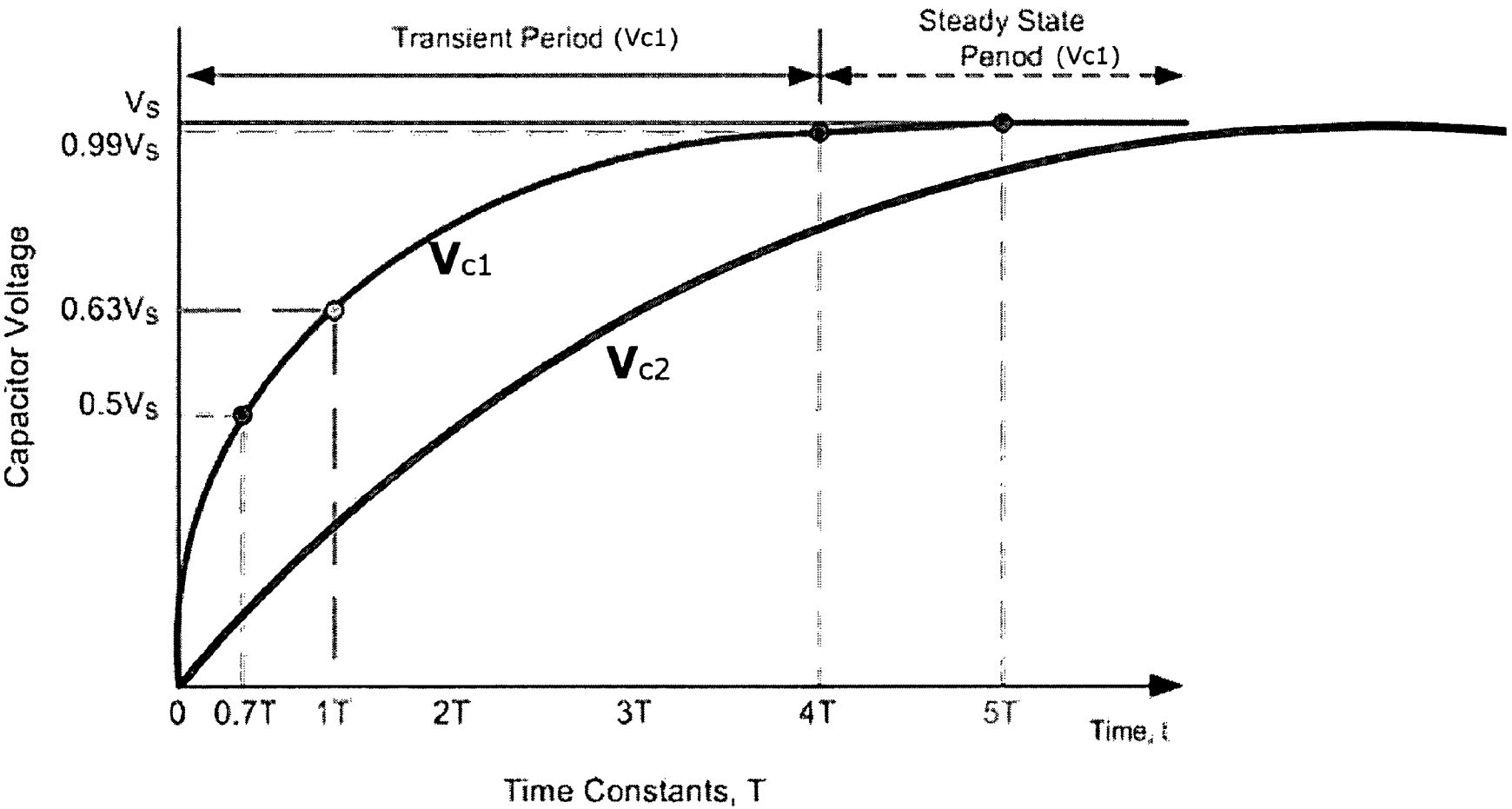
FIG. 7 is a graph of the voltage across capacitor 1 and capacitor 2 in response to an applied signal.

With reference to FIG. 7, when an increasing D.C. voltage is applied to a capacitor it begins to charge to the supply voltage (Vs) and draws a charging current. The time required for the voltage across a capacitor to reach the supply voltage is equivalent to 5 time constants or 5T. The voltage across $C_1$ rises faster to Vs in response to increases in the rectifier output than the voltage across $C_2$ in response to the same rectifier output resulting in a voltage differential that is amplified by the op amp and outputted to the input pin of the 4047BE of the pulse generator 130 via switch 33. Capacitor $C_2$ quickly catches up with its faster counterpart and reaches Vs thereby eliminating the differential and the consequent signal from the op amp to the pulse generator 130. This equilibrium at Vs is maintained even as the note is sustained or fades, with Vs gradually diminishing and $V_{C1}$ and $V_{C2}$ also falling in concordance (See FIG. 8*c*). When each new note is played, a new, higher Vs level is established and each capacitor charges to match it. However, because $T_{C2}$ is 50% longer than for $T_{C1}$, $T_{C1}$ always increases to the new Vs quicker in response to a signal step creating a voltage differential that is detected by the op amp and signaled to the display.

Figures 8A, 8B, 8C:
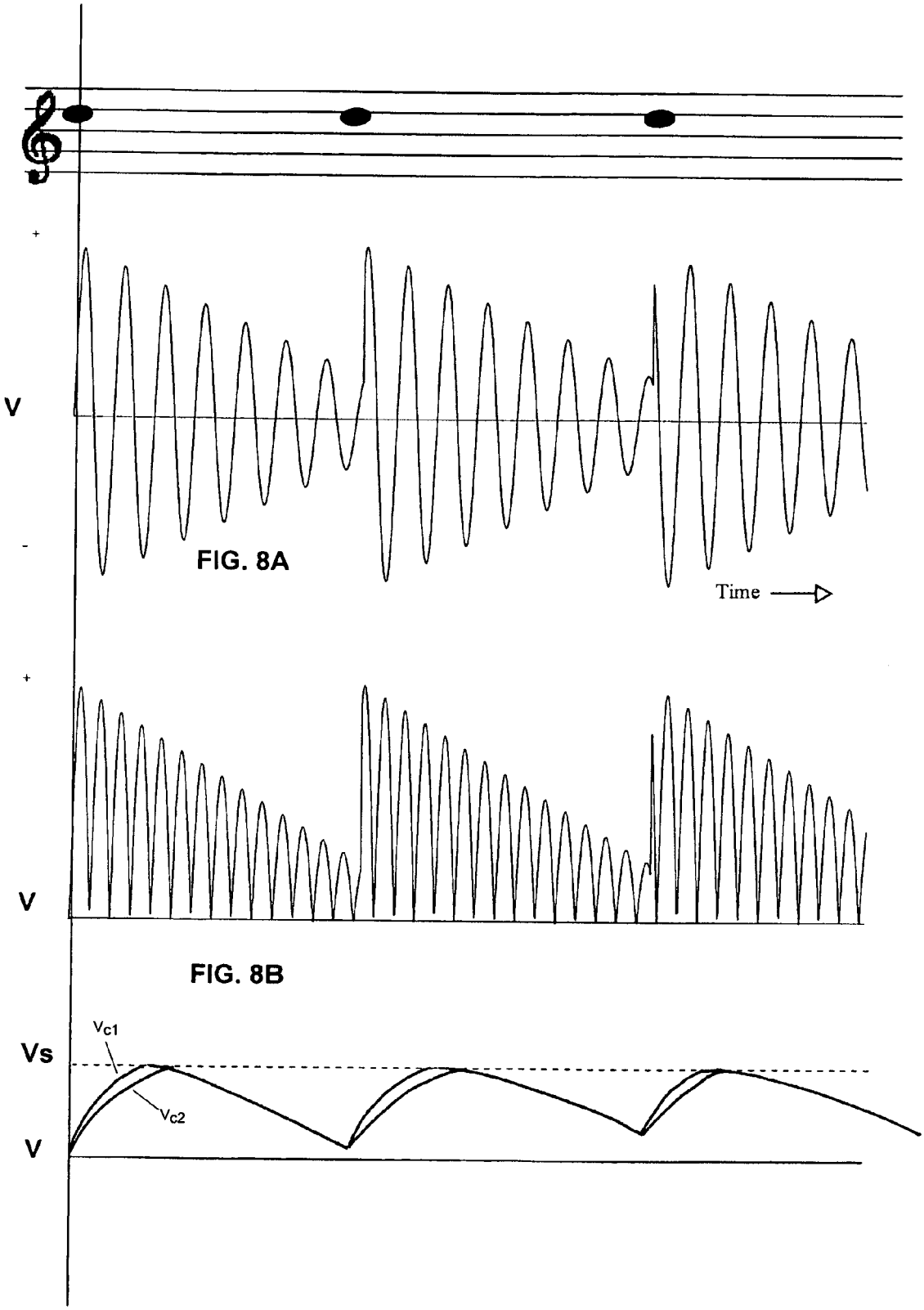
FIG. 8*a* is simplified graph of the inputted signal wave form.
FIG. 8*b* is simplified graph of the rectified signal wave form.
FIG. 8*c* is representational graph of the voltage across certain elements of the device over time in response to the inputted signal wave form of FIG. 8*a*.

FIGS. 8*a* through 8*c* depict this detection process for three notes played in succession. FIG. 8*a* depicts three exemplary notes and a simplified representation of the wave form received by the device from the instrument. Observe that each note is played with the same initial intensity and then immediately begins to fade as the string vibrates with gradually diminishing energy until the subsequent note is played. At FIG. 8B the initially received wave form is fully rectified. At FIG. 8C the voltage across $C_1$ and $C_2$ are graphed over time in response to each note. Observe that Vs for each note is the same in this example as each note was played with the same intensity. Where subsequent notes are played with differing intensity Vs for each note would be correspondingly different. Observe that as with FIG. 7, C1 reaches Vs before C2 in each case signaling a note has been played. The differential between the two is amplified by the LM324 operational amplifier of the comparator 125 and outputted to the pulse generator 130.

With renewed reference to FIGS. 5 and 6, pulse generator 130 provides a single discrete voltage pulse to the input of averaging filter 140 in direct response to the note detection signal output of the dual filter and comparator 120, as the LFO 150 provided previously described. Pulse generator 130 simultaneously signals a false trigger prevent 135 to prevent additional trigger signals from the dual filter and comparator 125 to the pulse generator 130 for a given time interval. False trigger prevent 135 eliminates duplicate note identification from a single note where the note waveform increase is sustained such as with sustained tremolo or similar notes of intentionally varying voltage amplitude. False trigger prevent 135 may be 2n5088 general purpose amplifier receiving the pulse generator 130 signal at its base terminal and temporarily grounding the output of the comparator 125 in response to the base signal input. The duration of the false trigger prevent 135 lock out will be varied in response to the operation of range switch 35 described above to a period appropriate to the timing of notes in the selected range. This may be accomplished by providing a 027 μf capacitor or similar to ground when the range switch 35 is set to 0-11 note per second to lengthen the lockout window.

In operation, a user can set the switch 33 to metronome mode to provide an exemplary sound cue corresponding to a given number of notes per second, and monitor the user's rate of play as he tries to match the demonstrated rate. Alternatively, the switch 33 can be set to speedometer mode to monitor both overall rate of play and regularity of the rate of play. Adjustable sensitivity of the device for both note timing accuracy (display sensitivity set via easy/hard switch 37) and note speed of play (display range set via switch 35) is provided such that users of varying skill levels may use the device. In the exemplary embodiment an analog display indicates the speed of play in terms of notes per second on the calibrated dial. Once a target speed has been established by the musician, the direction of the needle deflection above or below the target speed is indicative of whether the musician is too slow or two fast. As the musician becomes more skilled in his instrument the sensitivity may be recalibrated in keeping with his ability. It should now be apparent that the device provides instantaneous feedback in real time regarding both speed and regularity of note timing, so that musicians can improve performance and quantitatively compare speed of play with other musicians.

Having now set out an exemplary embodiment of the present invention, it should be understood that the invention may be used with a variety of materials and components. Consequently, while this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. A device for providing a visual indication of the rate at which musical notes are played on a musical instrument, comprising:

an input for receiving an input signal from a musical instrument;

a note detection circuit electrically connected to said input for isolating discrete musical notes and for generating a note event signal each time a musical note is identified, said note detection circuit further comprising;

a signal rectifier electrically connected to said input;

a comparator for identifying an increase in signal indicative of a note being played on the instrument, said comparator further comprising a first branch circuit and a second branch circuit, said first branch circuit having a shorter time constant than said second branch circuit; and an amplifier for amplifying the voltage difference between said first branch circuit and said second branch circuit; and a display electrically connected to said note detection circuit and adapted to display the instantaneous speed of notes played on said musical instrument as a function of time, said display further comprising a pulse generator electrically connected to said amplifier for signaling a note identification event; a meter driver electrically connected to said pulse generator for driving a display; a meter display means electrically connected to said meter driver and calibrated to indicate the number of identified notes described by the input signal per second.

2. The device of claim 1 wherein said first branch circuit comprises a first capacitor and a first resistor and said second branch circuit comprises a second capacitor and a second resistor, the time constant of each branch circuit being a function of the capacitance of said capacitors.

3. The device of claim 1 further comprising a pulse retarding means electrically connected to said pulse generator and said comparator for temporarily inhibiting multiple note identification from a single musical note.

4. A method of determining the speed with which musical notes are played on an electric instrument comprising the steps of:

receiving an electrical signal from an electrical musical instrument;

providing a first circuit branch and a second circuit branch, said first circuit branch having a shorter time constant than said second circuit branch;

providing the signal to the first circuit branch and the second circuit branch, whereby a voltage across the first branch circuit due to a first note being played reaches a first signal supply voltage more quickly than a voltage across the second branch circuit resulting in a temporary voltage differential indicative of a note being played, the voltage differential being eliminated when the second branch circuit subsequently reaches the first supply voltage, such that a voltage differential generated between the first and second circuits due to a second supply voltage of a second note being played may be identified without regard to a residual voltage produced by the sustained signal of first played note in decay;

comparing the voltage across said first circuit branch with the voltage across said second circuit branch to identify incidents of voltage increase;

generating an electrical pulse on identification of instances of increased voltage.

5. The method of claim 4 wherein the step of providing a first circuit branch and a second circuit branch is further comprised of the sub-steps of providing a first capacitor and a first resistor in said first circuit branch and a second capacitor and a second resistor in said second circuit branch, the time constant of said first branch being a function of said first capacitor and the time constant of said second branch being a function of said second capacitor.

6. The method of claim 5 wherein the step of comparing the voltage across said first circuit branch with the voltage across said second circuit branch to identify incidents of voltage increase is further comprised of the sub-steps of providing an operational amplifier, the first input lead said operational amplifier electrically connected to said first branch circuit and the second input lead of said operational amplifier electrically connected to said second branch circuit.

7. The method of claim 4 further comprising the step of filtering said signal to remove frequencies below 80 hertz.

8. The method of claim 4 further comprising the step of rectifying the signal.

9. The method of claim 8 wherein said signal is fully rectified.

10. The method of claim 4 further comprising the step of providing a variable gain amplifier.

11. The method of claim 4 further comprising the step of providing the electrical pulse to a display adapted to indicate the number of notes played per second.

12. A device for determining and displaying the instantaneous rate at which sustained melodic musical notes are played on a musical instrument comprising:

a housing, an input in said housing for receiving an input signal representative of the sound made by a musical instrument;

an output in said housing for outputting the input signal whereby the signal may be provided to an amplifier;

a comparator electrically connected to the input for identifying increases in voltage of said signal; said comparator further comprises a first branch circuit and a second branch circuit, said first branch circuit having a longer time constant than said second branch circuit; and an operational amplifier electrically connected to said first branch circuit and said second branch circuit and adapted to output the difference between the voltage across said first branch circuit and the voltage across the second branch circuit resulting from an increase voltage of said signal;

a pulse generator electrically connected to said operational amplifier for generating an electrical pulse when a voltage differential is outputted by said comparator;

a meter driver electrically connected to said pulse generator for driving a display;

a display electrically connected to said driver and calibrated to indicate the number of notes described by the input signal per second (NPS).

13. The device of claim 12 wherein the signal is generated by an electric musical instrument.

14. The device of claim 13 wherein the signal is provided in the form of an alternating current.

15. The device of claim 14 further comprising a rectifier electrically connected to said input whereby the signal is rectified.

16. The device of claim 12 further comprising a low cut signal filter electrically connected to said input.

17. The device of claim 12 wherein said first branch circuit comprises a first capacitor and a first resistor and said second branch circuit comprises a second capacitor and a second resistor, the time constant of each branch circuit being a function of the capacitance of said first and second capacitors.

18. The device of claim 12 wherein the time constants of said first branch circuit and said second branch circuit are adapted to identify up to 22 musical notes played per second.

19. The device of claim 12 wherein the display further comprises an analog dial and a rotary needle calibrated to display the instantaneous rate that musical notes are played in terms of notes per second.

20. The device of claim 19 wherein the sensitivity of the comparator and the calibration of the display may be switched as between a first range of 0-11 notes per second and a second range of 0-22 notes per second.

21. The device of claim 12 further comprising a signal generator whereby an exemplary signal indicative of the number of notes per second a user desires to play is provided.

22. The device of claim 21 wherein the exemplary signal is made audible by a speaker.

23. The device of claim 21 wherein the exemplary signal is visually indicated.

24. The device of claim 12 further comprising a false trigger prevention circuit whereby the comparator is temporarily prevented from signaling the pulse generator that a musical note has been played.

25. A device for providing visual and auditory feedback to a musician playing a musical instrument, comprising:

an analog input electrically connected to a musical instrument for receiving an input signal representative of the sound made by said musical instrument;

a real time note detection circuit electrically connected to said input for discerning discrete musical notes played on said musical instrument and for generating a signal corresponding to a rate of notes played on said musical instrument;

a display electrically connected to said note detection circuit and adapted to display the instantaneous rate of notes played on said musical instrument.

26. The device of claim 25 wherein said musical instrument is an electrical musical instrument and wherein said note detection circuit further comprises a comparator having a first branch circuit and second branch circuit, said second branch circuit having a longer time constant than said first branch circuit, said comparator identifying a difference between the signal of said first branch circuit and said second branch circuit resulting from said longer time constant and indicative of a note being played.

27. The device of claim 26 wherein said display further comprises a signal generator connected to said comparator for signaling that a note has been played, a meter driver electrically connected to said signal generator for driving a meter display; and a meter display means electrically connected to said meter driver and calibrated to indicate the instantaneous rate of notes played in terms of notes per second.

28. The device of claim 25 further comprising a metronome circuit for adjustably generating a timing signal; and wherein said display is switchably connected to said metronome circuit for displaying the rate at which said timing signals are generated and to said note detection circuit displaying the rate at which said notes are being played on said musical instrument.

* * * * *